United States Patent [19]

von der Eltz et al.

[11] Patent Number: 4,862,546

[45] Date of Patent: Sep. 5, 1989

[54] PROCESS OF TREATING TEXTILE MATERIAL IN JET DYEING MACHINES AND APPARATUS FOR PERFORMING SAME

[75] Inventors: Hans-Ulrich von der Eltz, Frankfurt am Main; Wilhelm Christ, Michelbach/Bilz, both of Fed. Rep. of Germany

[73] Assignee: Hoechst Aktiengesellschaft, Fed. Rep. of Germany

[21] Appl. No.: 221,759

[22] Filed: Jul. 20, 1988

[30] Foreign Application Priority Data

Jul. 21, 1987 [DE] Fed. Rep. of Germany ..... 3724075

[51] Int. Cl.[4] ..... D06B 3/28

[52] U.S. Cl. ..... 8/149.1; 8/152; 8/158; 68/5 C; 68/178

[58] Field of Search ..... 8/149.1, 149.2, 149.3, 8/152, 158; 68/5 C, 177, 178, 207

[56] References Cited

U.S. PATENT DOCUMENTS

| | | | |
|---|---|---|---|
| 1,948,568 | 2/1934 | Faber et al. | 68/5 C X |
| 3,921,420 | 11/1975 | Aurich et al. | 68/178 X |
| 3,949,575 | 4/1976 | Turner et al. | 68/5 C |
| 4,351,076 | 9/1982 | von der Eltz et al. | 8/149.3 X |
| 4,483,032 | 11/1984 | Christ et al. | 8/149.1 |
| 4,726,088 | 2/1988 | Eckrodt | 8/152 |

*Primary Examiner*—Philip R. Coe

*Attorney, Agent, or Firm*—Connolly & Hutz

[57] ABSTRACT

Process and apparatus are provided for the batchwise wet treatment of textile material with an aqueous liquor that contains dyestuff or other textile processing products according to an exhaust technique. Textile material in continuous loop form is recirculated in a jet dyeing machine, and a recirculating gas stream propels the material. A blower recirculates the gas stream while aqueous liquor is metered into the stream by aspirating the liquor at the upstream side of the blower. The action of the blower finely disperses the liquor within the gas stream.

12 Claims, 7 Drawing Sheets

Figure 1:
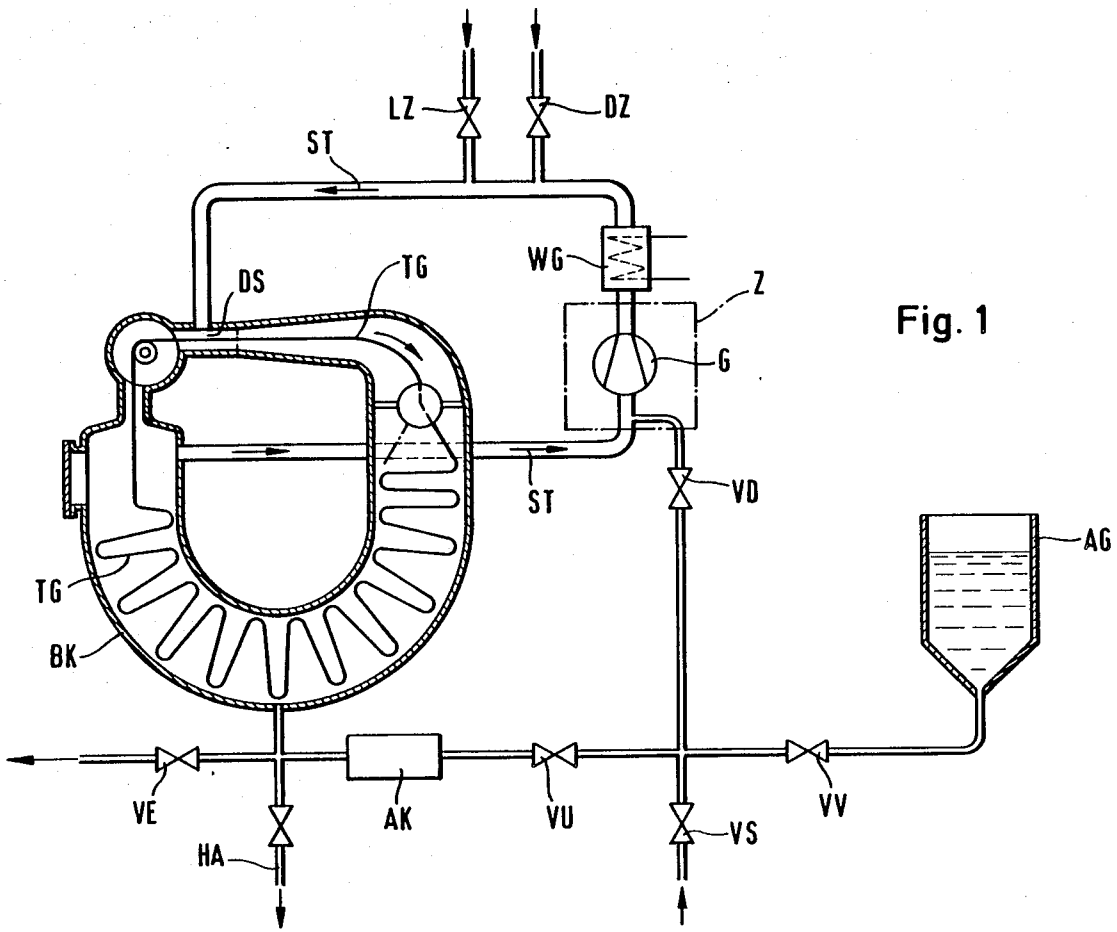

PROCESS OF TREATING TEXTILE MATERIAL IN JET DYEING MACHINES AND APPARATUS FOR PERFORMING SAME

The present invention relates to an (improved) process for the batchwise wet treatment of textile material made of synthetic or natural fibers or mixtures thereof recirculating in a jet dyeing range in a continuous loop rope form, with an aqueous liquor containing dyestuff suitable for the particular fiber type by the exhaust technique, or of other textile processing products, the propulsion for the transport of the textile material within the self-contained jet range being provided via the actuation of the jet system by means of the kinetic energy of a recirculating gas stream which is not inert in relation to the intended specific treatment effect and which is admixed at the same time with the treating agent or treating agent formulation which, thus brought into contact with the textile material under the preselected temperature and pressure conditions, immediately becomes active there in the fixing state.

A congeneric process where textile material ropes are subjected to a wet treatment, in particular a dyeing process, in jet piece dyeing ranges is described in European Patent Specification EP-B-0,078,022. By the principle explained in said reference for the dyeing of textile material in continuous loop form and by which the seamless transition of successive treatment operations is possible under isothermal conditions without stopping the textile material, the dissolved or dispersed treating agent is added in atomized form to the driving, non-inert gas stream in the nozzle section of a specific injection cycle, i.e. on the pressure side of the blower generating the gas stream. This requires a pump (preferably a rotary pump) which generates the differential pressure required for injecting the treating agent into the gas stream, and a nozzle which atomizes the treating liquor, the quantity to be injected being set within the capability of the pump. To control such an operating pump, a sufficient volume of treating liquor must be present on the aspirating side of the pump and the total pressure in the pump intake port must be higher by a minimum amount than the vapor pressure of the treating liquor in the intake pipe of the pump. The liquor ratio present in the existing process, based on the ratio between the weight of the textile material in kg and the volume of the treating liquor in liters, follows from the volume of moisture on the textile material, the volume of treating liquor on the aspiration side of the pump and the capacity of the injection system including the pump, the pipes, heat exchangers and fittings. To limit the total volume of treating liquor, a high level of measuring and regulating resources is required in this process.

It is thus an object of the present invention to employ suitable measures to lower the liquor ratio still further and to simplify the process flow.

This object is achieved according to the invention when the treating agent formulation is metered into the driving gas stream on the aspiration side of the blower generating this gas stream, the blower effecting the fine division of the treating agent formulation by atomizing into the gas flow.

The characteristic feature of the present invention compared with the prior art as represented by European Patent Specification EP-B-0,078,022 is the omission of the separate injection cycle for the treating agent to be introduced, i.e. the injection cycle is thus no longer a self-contained machine system but is in direct connection to the gas cycle insofar as the driving force for the introduction of the treating liquor emanates not from a system composed of injection pump and nozzle but from the aspirating jet action of the blower maintaining the gas cycle. The fact, then, that the treating liquor is admixed to the gas stream on the aspiration side of the blower and that the fine division of said liquor is effected by atomization in the gas stream due to the conveying work of the blower, aside from producing the commercial advantage of further energy saving, results in an appreciable simplification of the machine system and of the control resources required for implementing the process.

This inventive idea was thought to be impracticable because of the fact that inside the blower appreciable forces of acceleration act upon the droplets of the treating liquor divided by the gas stream, from which it should have been expected that the treating liquid introduced does not remain uniformly distributed due to coalescence on the impeller blades of the blower and in the pressure side part of the housing.

It was further feared that in particular in the case of liquors containing treating agents dispersed therein the forces of acceleration which arise would cause precipitation of the treating agents and hence inhomogeneities in the liquor.

It was therefore surprising that the treating liquors can be applied, i.e. introduced into the dyeing system, in this simple, inventive way.

As regards the manner of the wet treatment, the present invention has a wide range of applications and can be used for example, regardless of the specific nature of a wet treatment, for the dyeing, processing, etc. of textile material, in particular wherever the concern is the minimum addon of treating agents applied permanently to the textile material. Depending on the type of the intended wet treatment operation, it can be sufficient irrespective of the textile material to be treated in the jet range if the metered addition of treating agent formulations into the gas stream is effected in such a way that the liquor ratio established in the dyeing system ranges, in respect of the total amount of Liquor which is used in this way, up to the liquor retention capability of the textile material. In other cases, however, it can appear necessary or advisable to meter the liquor formulations from the treating agent into the gas stream in such a way that the liquor ratio established in the dyeing system is such, as regards the total amount of liquor introduced in this way, as to exceed the liquor retention capability of the textile material.

The claimed process is advantageously also applicable to multistage wet treatment operations which necessitate various separate metered additions of liquid treating agent formulations. Depending on the circumstances, in such a procedure at least one partial liquor will then be metered into the gas stream according to the invention, from the aspiration side of the blower, while addition of further partial liquors for the other stages of the process can take place in accordance with conventional guidelines. If a plurality of partial liquors are to be metered in separately in succession to an operating jet system conforming to the feature of the present invention, it can be convenient to dimension the quantities for each partial liquor, for example for the first partial liquor for a pretreatment step (such as wetting), in such a way that in the end the liquor ratio for the actual measure (such as dyeing) considered to be the chief part of the procedure and quantitatively desired for said chief measure results.

The novel process described above has the following advantages over the prior art processes, in particular the process of European Patent Specification EP-B-0,078,022:

An even lower liquor ratio becomes possible in the dyeing system since the amount of treating liquor formulation can be kept very small, so that even if more than one liquor formulation is added the minimum liquor ratio depending on the treating process according to the invention can be maintained.

The addition of treating agent by the claimed procedure has virtually no effects, if any, or only rapidly reeliminable effects on any isothermal conditions previously set in the dyeing system.

The present invention produces a notable saving in energy from the reduced liquor ratio and from the elimination of the separate injection cycle and hence its regulating mechanisms, which also constitutes a significant simplification of the machine itself.

A lower liquor ratio also leads to savings in auxiliaries, in electrolytes (preferably in the case of dyeings with reactive and direct dyes), in dyes (having partition coefficients where a small liquor ratio results in higher bath exhaustion), in energy and finally in effluent, which moreover is less polluted. Even small amounts of excess liquor not bound in the direct material are reliably returned into the cycle, while with the prior art injection system higher amounts of the treating liquid had to be available from the start in order to ensure satisfactory operation of the injection pump.

Surprisingly, it has been found that dyeing in jet dyeing machines under the conditions of the invention a lower liquor ratio gives better levelness.

Apparatus suitable for carrying out the claimed process, and likewise forming part of the subject-matter of the present invention, consists of a jet dyeing range of conventional design comprising a self-contained, essentially annular treatment kettle for receiving/storing the textile material present in a continuous loop rope form and—at least during the wet treatment operation—for circulating said material by the actuation of a nozzle system built into the orbit of said material, the said kettle being connected to a separate cycle, guided through the same nozzle arrangement, for a gas stream solely responsible for or assisting with the propulsion of the textile material and including, from the nozzle arrangement onward, a limited section along which the textile rope is exposed to the influence of the kinetic energy of the drive gas, a blower, situated in the gas cycle, for generating and compressing the driving gas stream and mechanical means for uniformly introducing of treating liquors into the gas cycle, wherein, in the gas cycle, the connection points for the mechanical means for metering in and/or subsequently recyclizing the treating agent formulation circulating are arranged on the aspiration side of the blower without a separate pressure injection cycle being present.

Figure 4:
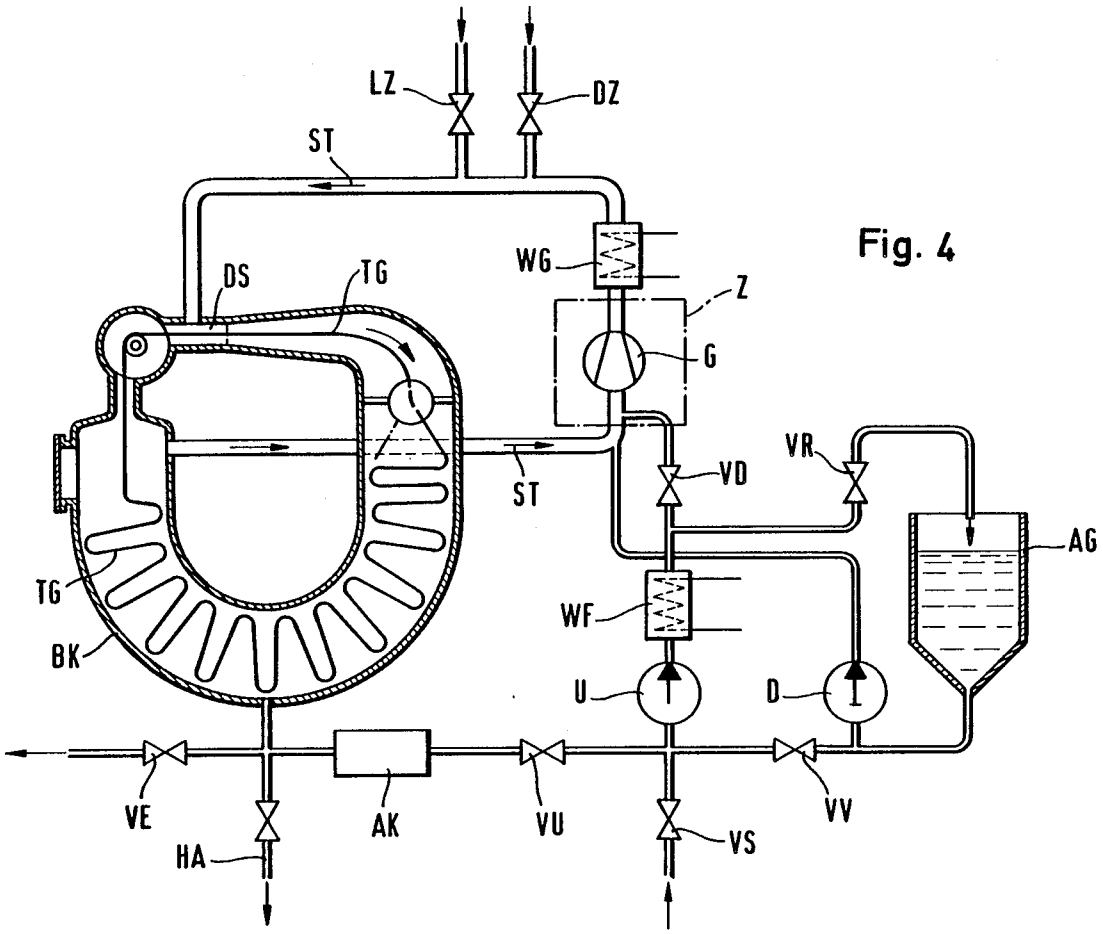
Figure 5:
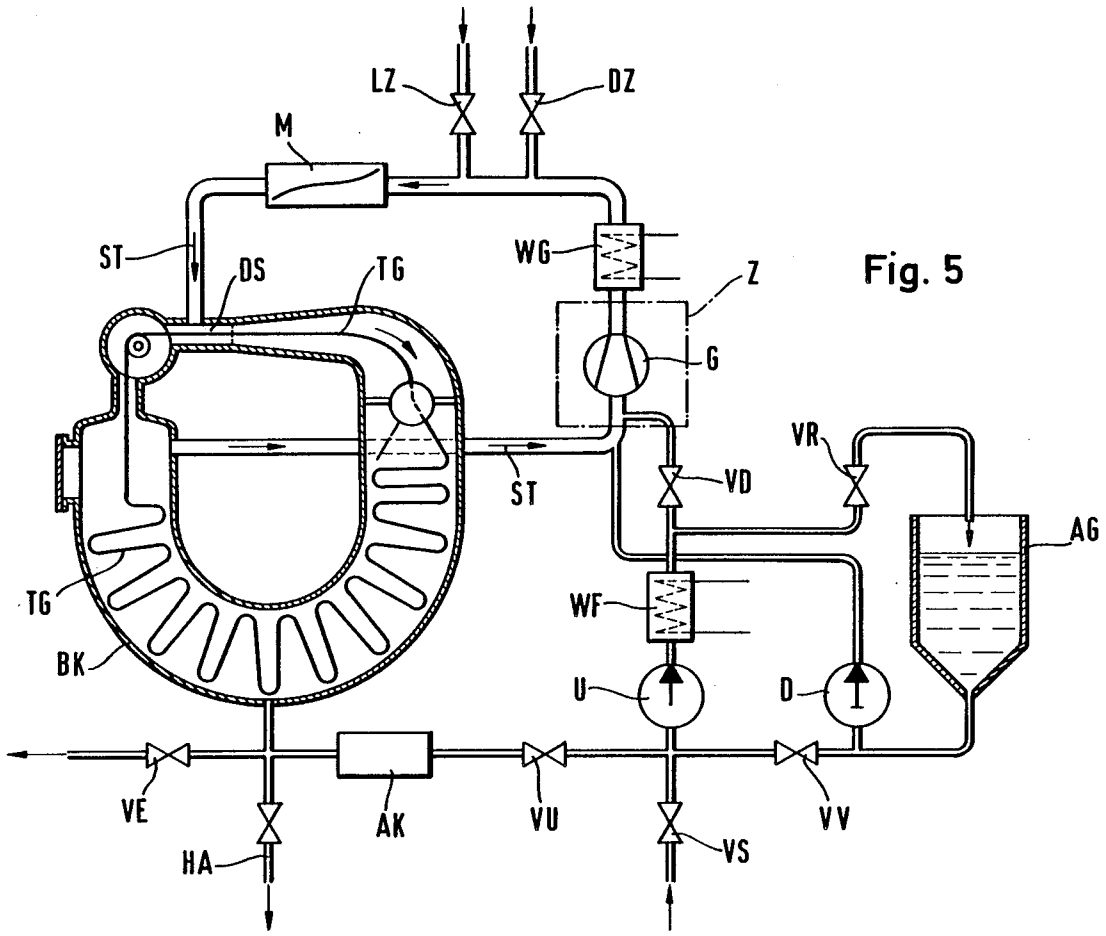
Figure 6:
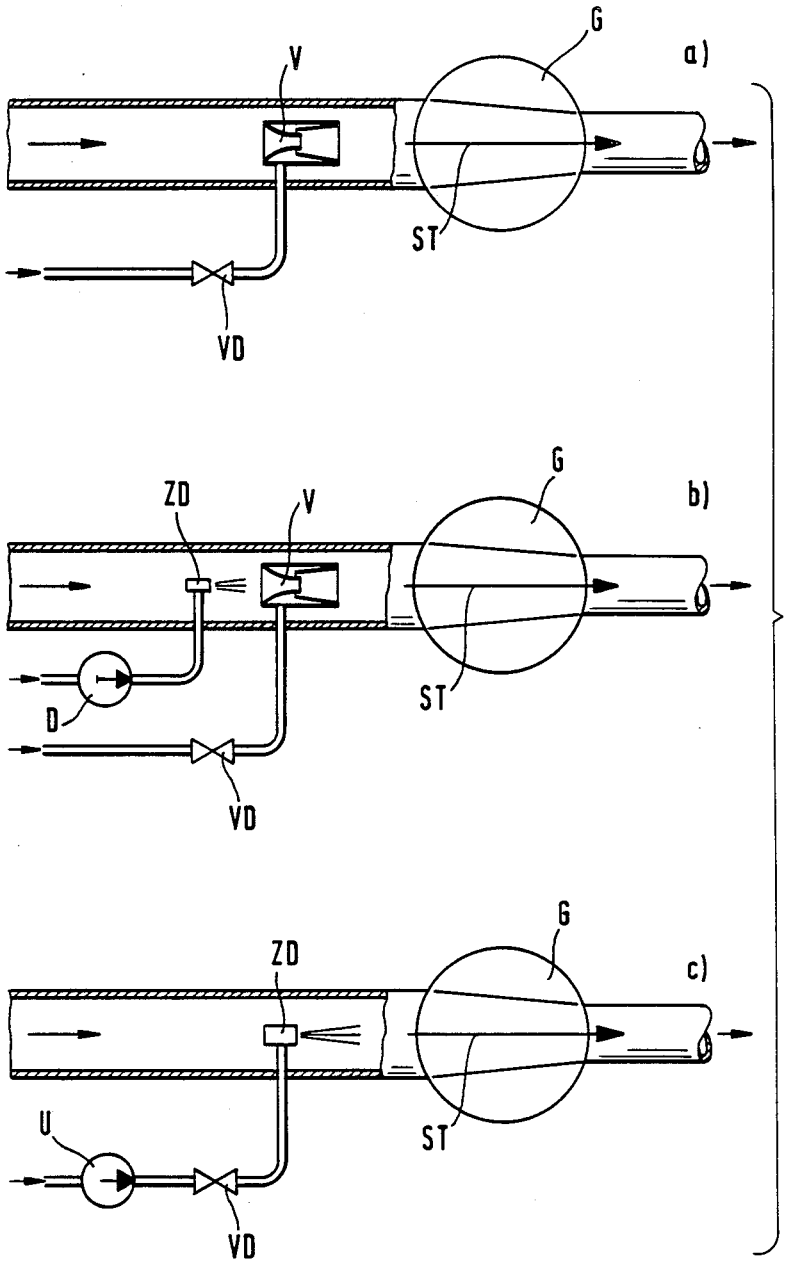
Figure 7:
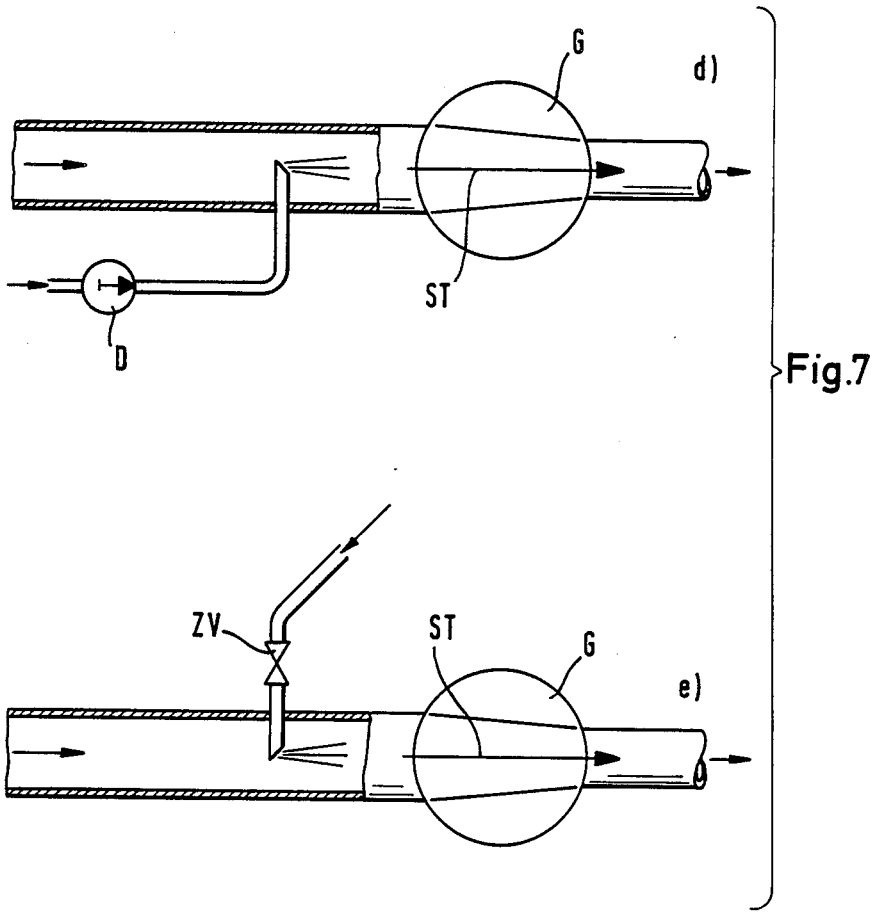

Working examples of such apparatus according to the invention are schematically depicted in the accompanying drawings, where FIGS. 1 to 5 show a cross-section through the dyeing jet as a whole and FIGS. 6 and 7 show detail Z from FIGS. 1 to 5, which depicts variants a) to e) of possible treating agent delivery elements.

The reference symbols used therein are identical to the letters used in the text for this purpose and have the following meaning:

AK = Collecting kettle for excess liquor
AG = Makeup vessel for treating agent formulation
BK = Treating kettle/fabric store
D = Metering pump for liquor delivery
DS = Nozzle (jet means)
DZ = Valve for steam supply
G = Blower
HA = HT -drain for liquor
LZ = Valve for air supply
M = Mixing means
TG = Textile material in rope form
U = Circulation pump for liquor circulation
V = Venturi pipe
VD = Throttle valve for metering of liquor
VE = Emptying valve for the liquor
VR = Return valve for the liquor
VS = Rinse water valve
VV = Prerun valve (connecting valve)
VU = Circulation valve
WF = Heat exchanger in liquor circulation system
WG = Heat exchanger in gas cycle
Z = Detail for representing variants of treating agent delivery elements
ZD = Atomizer nozzle for treating agent
ZV = Add valve
ST = Flow direction of driving gas The representation of the jet dyeing machine reproduced in FIGS. 1 to 5 corresponds substantially to the prototype of such apparatus as described in detail in U.S. Pat. No. 3,949,575.

In the further developed dyeing jet of FIG. 1 according to the invention, the machine layout is described in a fundamental first expansion stage: The heat exchanger (WG) arranged on the pressure side of the blower (G) is available as required for heating or cooling the circulating drive gas. It can also be equipped inter alia as a gas cooler to make it possible to keep the gas temperature constant even for a procedure at low dyeing temperatures, for example 30° C. Similarly, this heat exchanger (WG) can be used for cooling the gas cycle following a dyeing operation under HT conditions.

In FIGS. 2, 3, 4 and 5 there are included, within the abovementioned basic machine range, additional means which, depending on the particular application process, are individually usable for the jet.

Figure 2:
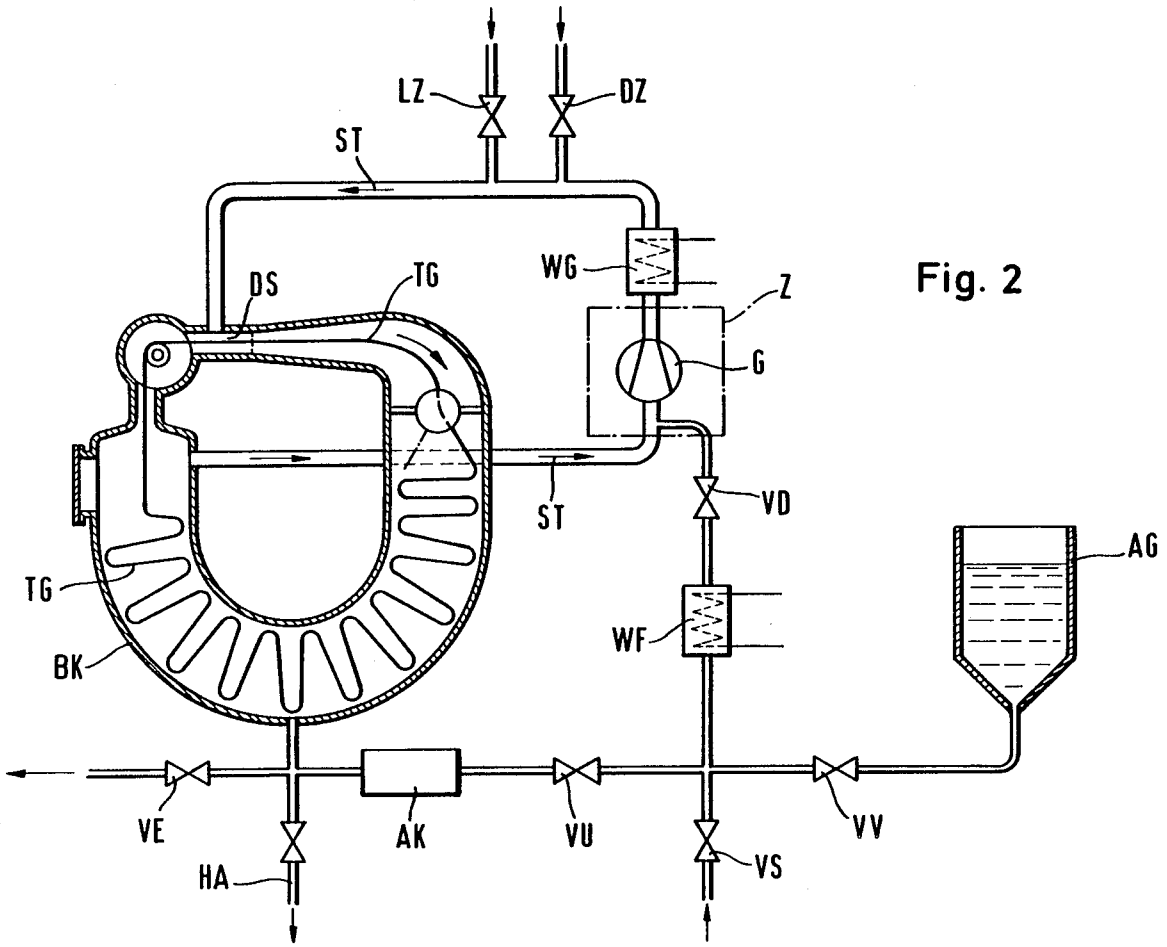

In the case of FIG. 2 this comprises the inclusion of a heat exchanger (WF), alternatively for heating or cooling, in the line for adding the liquor. This makes it possible, on the one hand, to feed the treating liquor into the aspiration pipe of the blower, for example during a heating up phase, at the same temperature as the gas temperature. It is similarly possible to heat the rinse water being supplied, so that it is possible inter alia to set a desired liquor temperature of 95° C. in one pass, for example for the aftertreatment of a reactive dyeing. If appropriately switched to cooling, such a heat exchanger (WF) can on the other hand be used for reducing the temperature in the gas cycle and hence for cooling down the entire system, so that the heat exchanger (WG) is then no longer required for such a task. The heat exchanger (WF) can also be used as part of the indirect heating of the treating medium for reducing the otherwise required direct steam quantity via the valve (DZ) or for cooling HT dyeings, it being possible, in each case for the heat exchanger (WG) to be taken out of operation if excess liquor is employed i.e. if the treating liquid flows through the valve (VU).

Figure 3:
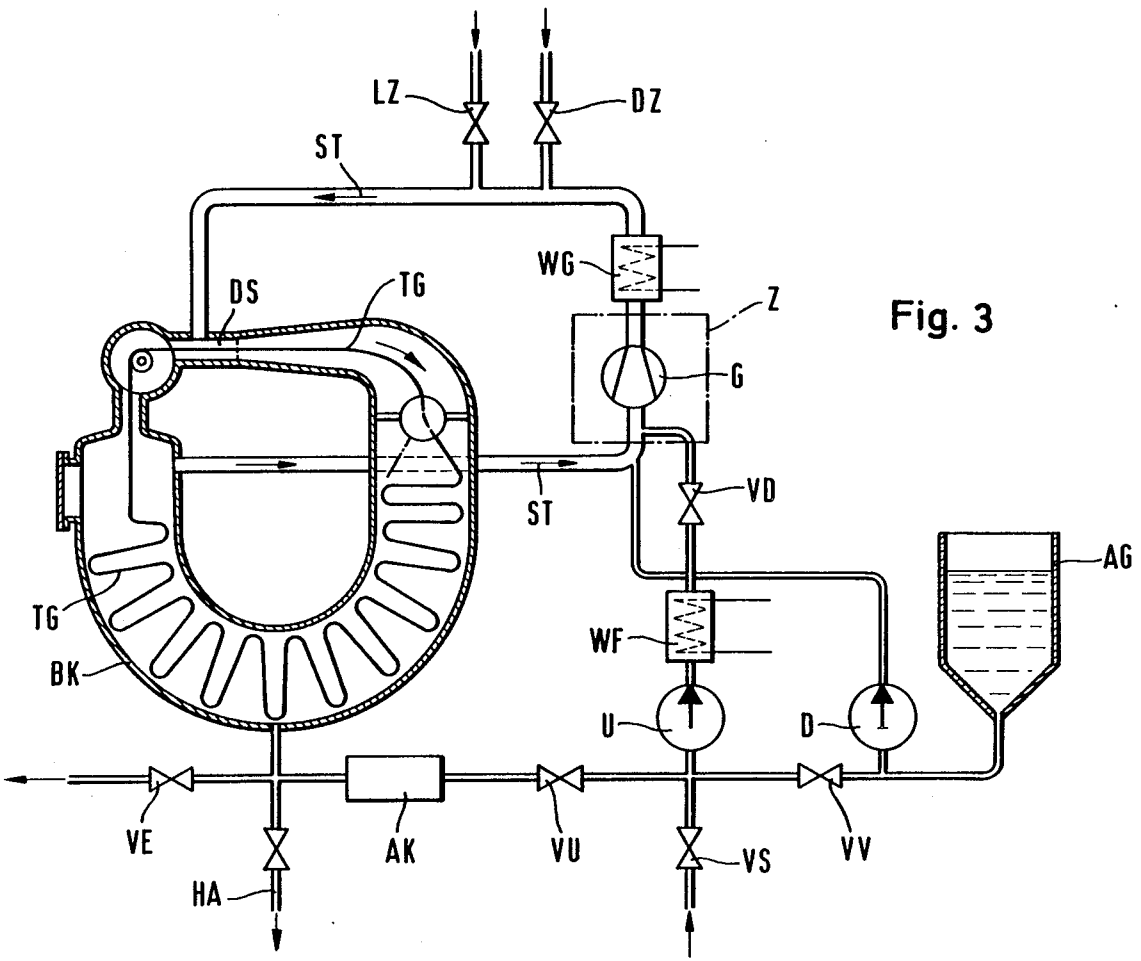

FIG. 3 depicts the additional installation of a circulation pump (U) and a metering pump (D). By means of the circulation pump (U), which is responsible for recirculating the liquor from the store (BK) to the blower (G), the liquor throughput can be increased in those processes where a relatively large quantity of excess liquor, i.e. liquor not bound in the textile material, needs to be employed. To include a metering pump (D), the system offers a plurality of connection possibilities as is shown inter alia in FIG. 6, variant b). However, owing to the atomization of the treating liquor into the gas stream by the blower (G), the abovementioned circulation pump (U) needs only to be designed for a lower delivery head than the operating pump described in European Patent Specification No. EP-B-0,078,022, as a result of which the power rating of circulating pump (U) is also correspondingly lower.

FIG. 4 shows the inclusion of a return valve (VR) for the liquor into the makeup vessel (AG). This arrangement is proposed for returning a stream of liquid delivered by the circulation pump (U) and then throttled by the valve (VD) back into the makeup vessel (AG) or very generally for returning the available mobile liquor portions (i.e. those not bound to the textile material) into the makeup vessel (AG), for example for the purpose of replenishing the treating liquor or for the removal of samples of dyed fabric without loss of liquor in the course of the production of HT dyeings.

FIG. 5 shows the presence of a mixing means (M) when a plurality of stores is connected in parallel. Such a mixing means (M) is situated in the gas pressure line downstream the blower (G) and prevents the formation of a condensate film from the atomized treating agent formulation on the inner surface of the pipe. Provision of such a mixing means (M) ensures that the recirculating gas volume will also transport the treated liquor finely divided in the gas to each of the stores in the same amount, so that as a result the processing effect, for example the depth of shade, will also become uniform from store to store.

The principle of functioning of the claimed apparatus can be illustrated as follows:

Even during the charging of the jet dyeing machine with the textile material (TG), a treating bath, for example a wetting bath, is introduced into the gas stream by the aspirating action of the blower (G). To this end, the said wetting bath was prepared in the makeup vessel (AG) in terms of quantity and concentration and was then, with the circulation valve (VU) in the closed position, introduced into the gas stream via the prerun valve (VV), through the metering valve (VD) and the aspirator pipe on the blower (G) and distributed within the nozzle (DS) on the textile material (TG).

After the textile material (TG) is introduced, the start and the end of the textile piece goods material are then sewn together, and the continuous loop fabric rope thus prepared is then kept in recirculation by means of the gas cycle while the remaining wetting bath is evenly distributed over the textile material.

After the treating kettle (BK) has been sealed, air and steam are fed in via the valves (LZ) and (DZ) to generate the driving gas mixture which creates the isothermal conditions and which is jetted into the machine while at the same time heating up the liquor already present therein. By regulating the valves (LZ) and (DZ) the requisite starting conditions for the gas mixture and the textile material (TG) are set for the dyeing operation. During this operation the circulation valve (VU) is in the open position, so that any treating liquor dripping off the textile material (TG) can be reaspirated via the metering valve (VD), and hence redispersed in the gas stream, by the blower (G). Between the valve (VU) and the pipe connection point situated at the lowest point of the treating kettle (BK) there is a collecting kettle (AK) for the excess liquor, said collecting kettle (AK) being advantageously equipped with a filter insert for filtering the treating liquid to remove any fluff or fiber shed by the textile material (TG). The size of the collecting kettle (AK) is selected in such a way that using the dyeing jet all widely used dyeing and processing operations are performable by an exhaust method on a very wide range of fiber materials, i.e. no permissible concentration of the treating liquor having to be exceeded. The connecting pipe leading from the collecting kettle (AK) to the circulation valve (VU) is arranged in such a way that in practice it is possible to work even without any treating liquor in the collecting kettle (AK); that is, even extremely low liquor ratios are usable according to the invention.

The heating up of the treating liquor introduced in the present use example as a wetting bath is due to the steam flowing in via the valve (DZ), specifically due to the heat released in the course of the condensation of the steam introduced in this way. Depending on the amount of the wetting bath and on the maximum moisture uptake of the textile material (TG), also referred to as liquor retaining capability, the volume of moisture produced by steam condensation is taken up by the textile material (TG) or—if the maximum retaining capability of the textile material (TG) has been reached even before the final temperature (in the case of isothermal processes, the dye- and fiber-dependent fixing temperature) has been reached — the additional increase in the treating liquor is stored by the collecting kettle (AK). The valve (VD) is then brought into a throttling position which corresponds to a quantity of liquid depending on the aspirating action of the blower (G). If, however, a too low pressure difference is present between the aspirating pipe of the blower (G) and the makeup vessel (AG), for example if a static overpressure of the gas mixture in the jet machine is present, the introduction of the dye formulation from the makeup vessel (AG) is effected not via the connection valve (VV) but via a metering pump (D). The throttle setting of the valve (VD) and the aspirating action of the blower (G), i.e. the liquid flow rate, determine the concentration of the gas-dispersed treating liquor which is brought into contact with the textile material (TG) in the nozzle arrangement (DS) under isothermal conditions.

The introduction of the treating liquor and/or the addition of product formulations, for example dissolved or dispersed dye, into the gas stream driving the textile material can take place according to the invention in several ways, the principle of which is evident from FIGS. 6 and 7. FIGS. a) to e) shown there each relate to detail Z from the layout for the dyeing jet conforming to FIGS. 1 to 5.

In the case of variant a) the metered addition of the treating liquor takes place in the area of the aspirating port of the blower (G) via a Venturi pipe (V) which, owing to the flow velocity in the nozzle cross-section, augments the aspirating action of the blower (G). If the system pressure is higher, the treating agent formulations are transported from the makeup vessel (AG) by means of metering pump (D), in which case the particular amount of liquor metered in is then essentially determined as the stream delivered through via the throttle setting of valve (VD).

Variant b) for the metered addition of the treating liquor represents an extension of variant a) in that the metering pump (D) permits the inclusion of a nozzle (ZD) in addition to the Venturi pipe (V) within the area of the aspirating port of the blower (G) and this pressure-dependent atomizer nozzle (ZD) is adapted to the delivery power of the metering pump (D).

The arrangement as per variant c) utilizes for the same purpose the circulation pump (U), which can also be equipped as a metering pump, and an atomizer nozzle (ZD), by means of which the treating liquor is injected into and dispersed in the gas stream. This pump (U), however, need only be very low-powered for this modification, since the downstream atomizer nozzle (ZD) can only be designed for a low pressure loss on account of the continued dispersal of the treated liquor in blower (G).

According to the provisions for variant d), a metering pump (D) delivers the treating liquor virtually without pressure through an outlet pipe into the gas stream.

In variant e), finally, the treating liquor is simply introduced into the gas stream via an outlet pipe in the manner of a downdraft carburator and then carried along in the gas stream and atomized in blower (G).

EXAMPLE 1

A jet dyeing range of the type according to FIG. 3 is entered with 180 kg of a dry textured polyester filament knitwear material in rope form, and the fabric transport is accomplished aerodynamically by means of compressed air in the form of a gas stream generated by a blower (G).

At the same time 300 l of an aqueous hot treating liquor at 85° C. containing — based on the proposed total amount of liquor —2 g/l of a leveling assistant based on a high molecular weight sulfo-containing polyester and 1.5 g/l of sodium acetate and also acetic acid for setting a pH of 4.5 are then introduced from the makeup vessel (AG) via the prerun valve (VV) into the recirculating gas stream. The metered addition of this entire liquor formulation into the gas cycle takes place on the aspiration side of the blower via a Venturi pipe (V) which predisperses the liquor in the steam. The final fine dispersion is then obtained with the blower (G) itself (treating agent delivery conforming to variant a).

After the textile material has been introduced and after the drive has been switched off, the textile material (TG) is sewn together at its two ends in such a way as to produce a fabric rope in continuous loop form. The inlet opening of the treatment kettle (BK) is then sealed, and the textile material is again set in circulation through the action of the blower stream in the nozzle (DS). Furthermore, steam is supplied via the regulating valve (DZ) to the pressure side of the running blower (G) and brought into contact with the textile material via the nozzle section (DS). Owing to the action of the steam, the temperature of the recirculating textile material increases along a predetermined gradient to approximately the temperature of the injected steam, and the dyeing vessel (BK) itself fills up with steam of the same temperature. As soon as a final temperature of 130° C. has been established, the steam supply is cut back to no more than the amount required for covering the heat losses.

After the fixing temperature of the dye has been attained or not until the dyeing temperature of 130° C. has been reached, 20 l of an aqueous hot dyeing liquor at 85° C. which — based on the weight of fiber — contains 0.55 % of the commercially available, blue disperse dye of the formula

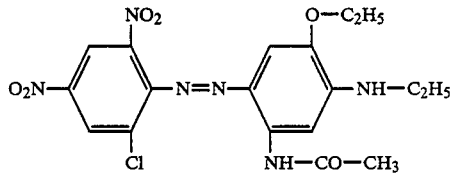

in the form of an aqueous dispersion are metered into the steam flow via the metering pump (D). This admixture likewise takes place on the aspiration side of the blower (G) analogously to the preceding mode of addition for the assistant liquor, although here the addition of the total amount of the above dyebath is distributed in the course of for example 10 circulations of the textile material. The circulation rates for the textile material and the gas are then maintained at the preselected dyeing temperature until the dyebath is exhausted, for 15 minutes in this case.

Using a so-called hot (HT)-drain (HA) the elevated static pressure established in the machine is then removed, which results adiabatically in a spontaneous cooling of the goods down to about 100° C. in the course of about 1 minute.

The textile material thus dyed is then hot rinsed at about 85° C., and the wash liquor used for this purpose is introduced from the makeup vessel (AG) via the prerun valve (VV) into the gas cycle and, after this treatment step has been accomplished, is removed again via the emptying valve (VE) with the circulation valve (VU) in the closed position. Such a rinsing step can take place semi-continuously using 2 vessel fill quantities and/or can also be carried out by means of excess liquor over a certain time period.

An aqueous hot aftertreating liquor at 80° C. containing per liter 5 ml of 32.5 % strength sodium hydroxide solution, 2 g of hydrosulfite and 1 g of an anionic surfactant is then added in the same way as before from the makeup vessel (AG) to the jet machine, heated to 95° C. by means of steam flowing in through valve (DZ) and left to act on the textile material for 15 minutes to effect reduction clearing of the dyeing thus produced.

Throughout all these rinsing and aftertreating operations the textile material is kept in continuous recirculation by the steam/hot air drive.

To finish the dyeing there then follow two further hot rinses (at 85° and 60° C.), and a cold rinse with water.

A completely level blue dyeing has been obtained on the knitwear material.

EXAMPLE 2

A jet dyeing range of the type according to FIG. 3 is entered with 150 kg of a dry polyester/cotton blend fabric in rope form, the transport of the fabric being effected aerodynamically by means of compressed air with the aid of a blower (G) generated gas stream and additional mechanical support in the form of a driven roll (in FIG. 3 without reference symbol).

At the same time as the textile material is being charged the precalculated amount of liquor is introduced as follows: 250 l of water of 80° C. containing 1.5 g/l of a leveling assistant based on a high-polymer sulfo-containing polyester and 1.5 l of sodium acetate and also acetic acid for setting a pH of 4.5 are metered into the recirculating gas stream on the aspiration side of the blower (G) effecting the propulsion of the textile material (treating agent delivery corresponding to variant b).

After the charging step has been completed and the circulation of the textile material (TG) has been stopped, the textile material (TG) is sewn together at its two ends in such a way as to form a continuous loop rope. The inlet opening of the treating kettle (BK) is then sealed, and the textile material is set in circulation again by switching the blower on again and adding steam in addition. The action of the steam serves to raise the temperature of the textile material.

As soon as a temperature of 120° C. has been reached, 50 l of an aqueous hot liquor at 80° C. which, based on the weight of fiber—contains a mixture of 0.4 % of the commercially available, yellow disperse dyestuff of the formula

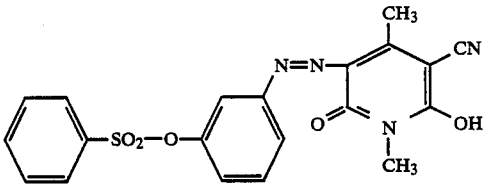

and 0.33 % of the commercially available, blue disperse dyestuff of the formula

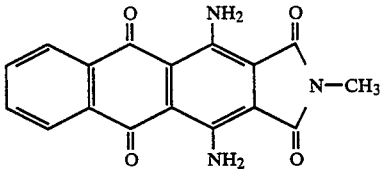

in the form of an aqueous suspension are then metered into the flowing steam under the then prevailing conditions. The liquor is fed in at a uniform rate over the period of time required to raise the temperature to the dyeing temperature of 130° C. by further injection of steam. This takes place on the aspiration side of the blower by means of a metering pump (D). The excess portion of the liquor which is not bound by the textile material is then kept in circulation while atomization continues, and the dyeing process is then continued at 130° C. for approximately a further 20 minutes until the dyebath is exhausted. The circulating liquor is then cooled down to about 85° C., on the one hand by actuating of a so-called hot (HT) drain (HA) and on the other by passage through the heat exchanger (WF), compressed air being admixed at a temperature of 100° C. downward to obtain a steam/air mixture.

With the subsequent introduction of hot water at about 60° C. to the treatment vessel (BK) via the valve (VS) the rinsing process for the polyester dyeing is started and completed by repeated bath changes at a simultaneously decreasing treatment temperature.

For the subsequent dyeing of the cotton portion of the blend fabric, the transport of the fabric is this time started with a hot stream of moist air from the nozzle system (DS) under an overpressure of 0.2 bar generated by the blower (G) supported again by the driven roll. At the same time a fabric temperature of about 40° C. is established.

At this temperature 50 l of an aqueous prerun liquor at likewise 40° C. prepared in the makeup vessel (AG) and containing — based on the total amount of liquor proposed for the dyebath — 50 g/l of anhydrous sodium sulfate, and a mixture of — based on the weight of fiber — 1.4 % of the commercially available, yellow reactive dyestuff of the formula

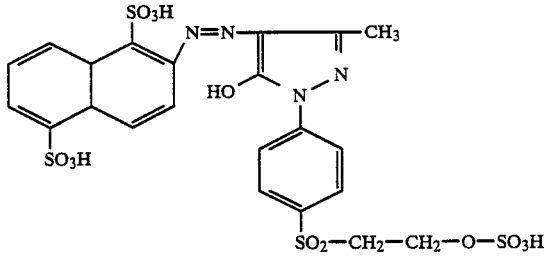

and 0.8 % of the commercially available, blue reactive dyestuff of the formula

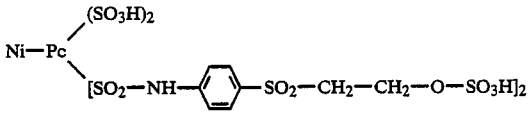

(Ni—Pc = nickel phtalocyanine)

in the dissolved state are then introduced into the jet machine in the same way as the liquor which contained the disperse dye.

For the subsequent fixing of the reactive dyes taken up by the textile material, 30 l of a further aqueous hot liquor at 60° C. containing 200 ml of 32.5 % strength sodium hydroxide solution and 1 kg of calcined sodium carbonate are then added 3 minutes later from the makeup vessel (AG) and metered via the metering pump (D) into the drive gas on the aspiration side of the blower in the course of 20 minutes. By the simultaneous addition of steam into the hot air stream, the dyeing temperature is then raised to 80° C. in the course of 30 minutes, and the circulating textile material is left at that temperature for 60 minutes. The aftertreatment of the dyeing by the introduction of rinse water into the dyeing range (BK) together with the subsequent treatment in a neutralizing and soaping bath is carried out in conformity with the otherwise customary method of working.

A level green dyeing has been produced on the polyester/cotton blend fabric.

EXAMPLE 3

A jet range of the type according to FIG. 3 is charged simultaneously with 300 l of an aqueous hot liquor at 40° C. containing — based on the total amount of liquor proposed for the dyebath — 50 g/l of anhydrous sodium sulfate, and a mixture of — based on the weight of the fiber 1.2 % of the commercially available dye Reactive Orange 16 of C.I. No. 17,757 and 0.5 % of the commercially available dye Reactive Yellow 17 of C.I. No. 18,852and 150 kg of a knitted cotton fabric. The knitted fabric is propelled by hot air recirculating via the jet nozzle; the liquor is added upstream of the blower which is responsible for recirculating the hot air and in which the dispersion of the liquor also takes place.

The propulsion is then switched off and the knitted fabric is sewn together to give a continuous loop rope, the treating kettle (BK) of the jet range is sealed, and the fabric is set in circulation again by means of a flow of hot air at 40° C.

After a run time of about 10 minutes a start is made on the metered addition of the alkali necessary for fixing the dyestuff. To this end a metering pump (D) is used to introduce 30 l of an aqueous liquor at 40° C. containing 300 ml of 32.5 % strength sodium hydroxide solution and 1.5 kg of calcined sodium carbonate into the hot air stream in the course of 30 minutes. The metered addition of this fixing agent is performed in terms of quantities in accordance with a 50 % progression, so that initially only very little of the alkaline liquor is added to the hot air stream upstream of the blower and consequently the concentration of alkali on the textile material approaches the predetermined final values only slowly.

After all the alkali liquor has been added, the textile material thus treated is left to circulate under the prevailing temperature and pH conditions for a further 30 minutes.

By addition of water at 40° C. via the rinse water valve (VS) a rinsing liquor is then introduced into the jet via the blower (G), and in this way the dyed textile material is rinsed several times. The subsequent soaping is carried out in a conventional manner, as is the final rinse.

A clear, level red dyeing has been produced on the knitted cotton-fabric. The fabric shows no loop distortions.

We claim:

1. In a process for batchwise wet treatment of textile material with an aqueous liquor that contains dyestuff or other textile processing products according to an exhaust technique comprising the steps of recirculating the textile material in a jet dyeing machine in a continuous loop form, propelling the textile material within a self-contained jet range of the machine by the kinetic energy of a recirculating gas stream introduced into the machine, adding the aqueous liquor to the recirculating gas stream to thereby bring the liquor into contact with the textile material, controlling the temperature and pressure conditions of the gas stream and the aqueous liquor, and recirculating the gas stream by means of a blower having upstream and downstream sides, the improvement comprising metering the addition of the aqueous liquor into the gas stream by aspirating the liquor at the upstream side of the blower, and finely dispersing the liquor within the gas stream by the action of the blower.

2. A process as in claim 1 wherein the step of metering the addition of the aqueous liquor is controlled so that the metered amount is approximately equal to the liquor retention capability of the textile material.

3. A process as in claim 1 wherein the step of metering the addition of the aqueous liquor is controlled so that the metered amount exceeds the liquor retention capability of the textile material.

4. A process as in claim 1 wherein the step of aspirating the liquor at the upstream side of the blower is accomplished with a Venturi.

5. A process as in claim 1 wherein the step of aspirating the liquor at the upstream side of the blower is accomplished by forcing the liquor through an atomizer nozzle into the gas stream.

6. A process as in claim 5 wherein the step of aspirating the liquor at the upstream side of the blower is also accomplished with a Venturi downstream of the atomizer nozzle.

7. A process as in claim 1 wherein the step of aspirating the liquor at the upstream side of the blower is accomplished by pumping the liquor into the gas stream.

8. A process as in claim 1 wherein the step of controlling the temperature and pressure conditions of the gas stream and the aqueous liquor is accomplished by applying a gas stream which is not inert in relation to the intended specific treatment affect and to which the aqueous liquor is isothermally added thus to immediately become active upon contact with the textile material in the fixing state.

9. Apparatus for batchwise wet treatment of textile material with an aqueous liquor that contains dye-stuff or other textile processing products according to an exhaust technique comprising a jet dyeing machine having a self-contained annular treatment chamber for receiving and storing the textile material in a continuous loop form, a nozzle arrangement in the annular treatment chamber, a separate gas stream cycle connected for introduction into the nozzle arrangement for propelling the textile material along the annular treatment chamber, a blower in the gas stream cycle upstream from the introduction of the stream into the annular treatment chamber for driving and compressing the gas stream, the blower having an aspiration side and a downstream side, and mechanical means connected to the aspiration side of the blower for uniformly introducing aqueous liquor into the gas stream.

10. Apparatus as in claim 9 wherein the mechanical means includes a Venturi.

11. Apparatus as in claim 9 wherein the mechanical means includes an atomizer nozzle.

12. Apparatus as in claim 9 wherein the mechanical means includes an atomizer nozzle in combination with a downstream Venturi.

* * * * *